US010906159B2

(12) United States Patent
Thetford et al.

(10) Patent No.: US 10,906,159 B2
(45) Date of Patent: Feb. 2, 2021

(54) SOCKET DEVICE

(71) Applicant: TOYOTA MOTOR ENGINEERING & MANUFACTURING NORTH AMERICA, INC., Plano, TX (US)

(72) Inventors: Jamie A. Thetford, Bradford, TN (US); Justin L. Hames, Finger, TN (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 164 days.

(21) Appl. No.: 15/966,069

(22) Filed: Apr. 30, 2018

(65) Prior Publication Data

US 2019/0329384 A1 Oct. 31, 2019

(51) Int. Cl.
*B25B 13/48* (2006.01)
*B25B 13/46* (2006.01)

(52) U.S. Cl.
CPC ..... *B25B 13/48* (2013.01); *B25B 13/46* (2013.01)

(58) Field of Classification Search
USPC ..... 81/121.1
See application file for complete search history.

(56) References Cited

U.S. PATENT DOCUMENTS 673,056 A * 4/1901 Jacobs ..... B25B 13/48 81/176.15
1,447,564 A 3/1923 Norlund et al.
2,826,388 A * 3/1958 Janos ..... A47B 96/068 248/239
3,086,414 A * 4/1963 Guy ..... F16B 23/0061 81/176.1
3,238,823 A * 3/1966 Snow ..... A43C 15/161 81/179
3,695,124 A * 10/1972 Myers ..... B25B 13/06 81/124.3
3,930,428 A 1/1976 Hale
4,947,712 A * 8/1990 Brosnan ..... B25B 13/065 81/53.2
5,152,195 A * 10/1992 Merrick ..... B25B 13/44 279/71
7,340,979 B2 * 3/2008 Sawyer ..... B25B 27/0042 81/120
8,826,780 B1 * 9/2014 Alho ..... B25B 13/06 81/124.2
D738,173 S 9/2015 Tempel
D787,906 S 5/2017 Chang
2009/0173189 A1 7/2009 Alford

FOREIGN PATENT DOCUMENTS

DE 295 12 682 U1 2/1996
DE 10 2011 013 150 A1 9/2012

* cited by examiner

*Primary Examiner* — Hadi Shakeri
(74) *Attorney, Agent, or Firm* — Oblon, McClelland, Maier & Neustadt, L.L.P.

(57) ABSTRACT

A socket includes a hollow cylindrical body having a first closed end and a second open end, wherein the first closed end includes a receptacle configured to receive a ratchet; a first flat surface located on an inner surface of the hollow cylindrical body; and a second flat surface symmetrically opposed to the first flat surface and located on the inner surface of the hollow cylindrical body.

17 Claims, 10 Drawing Sheets

BACKGROUND

BACKGROUND

BACKGROUND

SOCKET DEVICE

BACKGROUND

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

In certain industries, many hardware items are installed during original manufacture and removed and re-installed during maintenance. A myriad of tools exists for installing and removing these hardware items. However, there are still many instances in which a less-than-desirable tool or combination of tools needs to be used. Various safety issues can arise when a tool or combination of tools is used for a purpose other than its originally-intended purpose. In addition, damage can occur to the tool or combination of tools or to the part being installed or removed when the tool or combination of tools is used for a purpose other than its originally-intended purpose.

SUMMARY

In an exemplary embodiment, a socket includes a hollow cylindrical body having a first closed end and a second open end, wherein the first closed end includes a receptacle configured to receive a ratchet; a first flat surface located on an inner surface of the hollow cylindrical body; and a second flat surface symmetrically opposed to the first flat surface and located on the inner surface of the hollow cylindrical body.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

The following descriptions are meant to further clarify the present disclosure by giving specific examples and embodiments of the disclosure. These embodiments are meant to be illustrative rather than exhaustive. The full scope of the disclosure is not limited to any particular embodiment disclosed in this specification, but rather is defined by the claims.

It will be appreciated that in the development of any such actual implementation, numerous implementation-specific decisions need to be made in order to achieve the developer's specific goals, such as compliance with application- and business-related constraints, and that these specific goals will vary from one implementation to another and from one developer to another.

Embodiments described herein include specialized sockets which can be used to remove items that a conventional socket cannot remove. For example, the specialized sockets described herein can be used to remove a self-lock and pull-stud that are used in the automotive industry to hold two mold halves together during removal and maintenance of the mold halves. However, the specialized sockets can also be used to remove other items in which a conventional socket cannot be used.

A socket as used with embodiments described herein has dual adjacent pressure application flanges machined into its interior. This provides bi-directional forces to be applied on either side of the socket during installation or removal of an item. The precision machined internal diameter and mounting flange surfaces provide linear guides to prevent possible damage to a self-lock or other item to be removed and also provide a quicker and safer removal.

Figure 1:
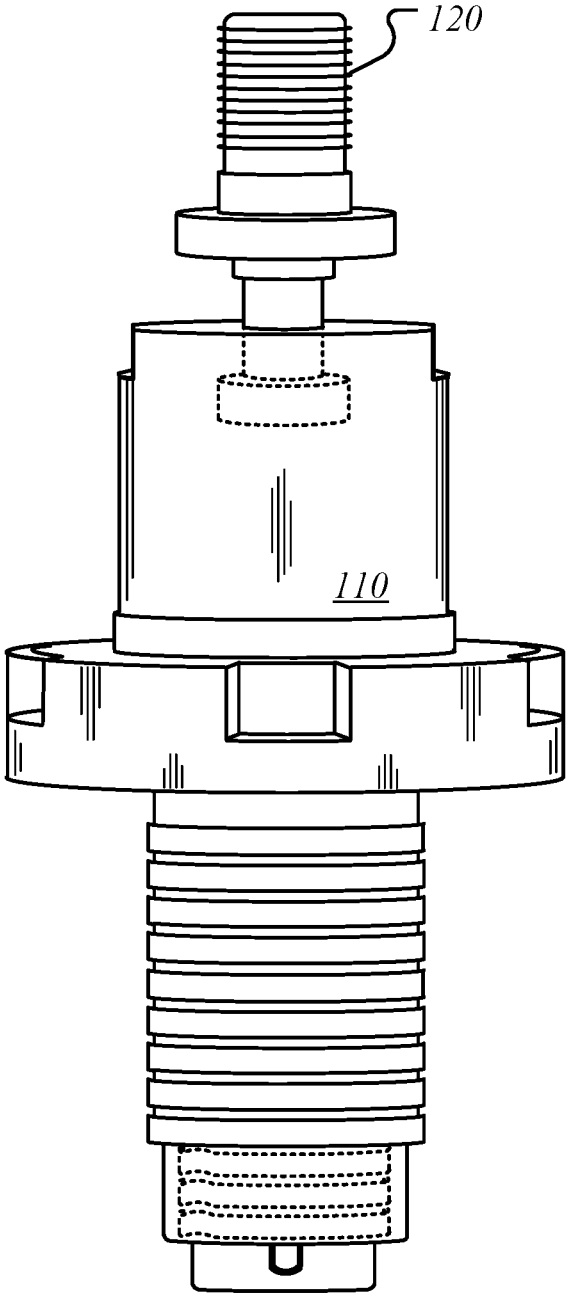
FIG. 1 is a schematic of a self-lock according to one embodiment.

FIG. 1 is a schematic of a self-lock 110 which has a cylindrical body at one end and a threaded portion at an opposite end. FIG. 1 also illustrates a pull stud 120. One end of the pull stud 120 is connected to the non-threaded end of the self-lock 110. An opposite end of the pull stud 120 is threaded.

Figure 2:
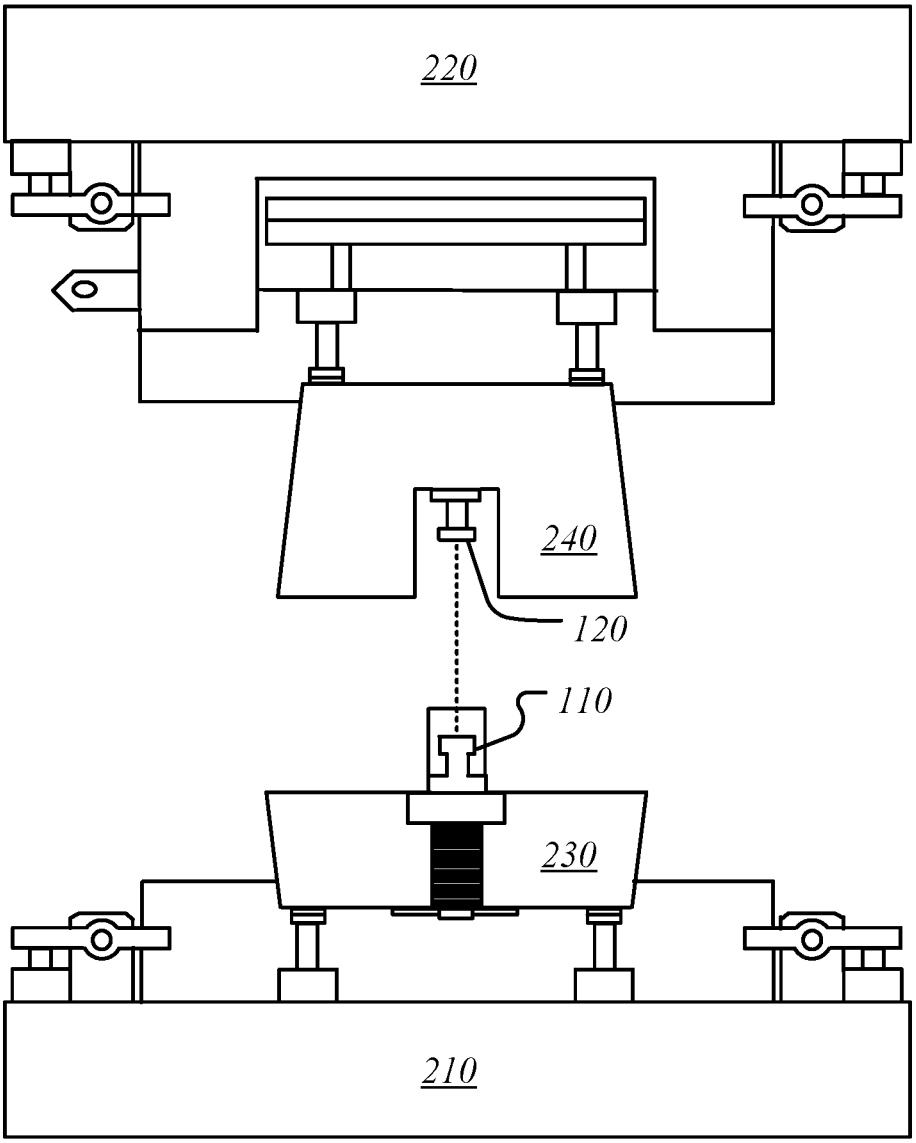
FIG. 2 is a schematic of a die cast machine according to one embodiment.

FIG. 2 is a schematic of a left die cast half 210 and a right die cast half 220 of a die cast machine. The left die cast half 210 has a left mold 230 secured to the left die cast half 210. The right die cast half 220 has a right mold 240 secured to the right die cast half 220. In one embodiment, the left mold 230 and the right mold 240 comprise an engine block aluminum casting dye.

When the threaded end of the self-lock 110 is installed with the left mold 230 and the threaded end of the pull stud 120 is installed with the right mold 240, the assembled self-lock 110 and pull stud 120 are tightened to hold the right mold 240 and the left mold 230 together.

Figure 3:
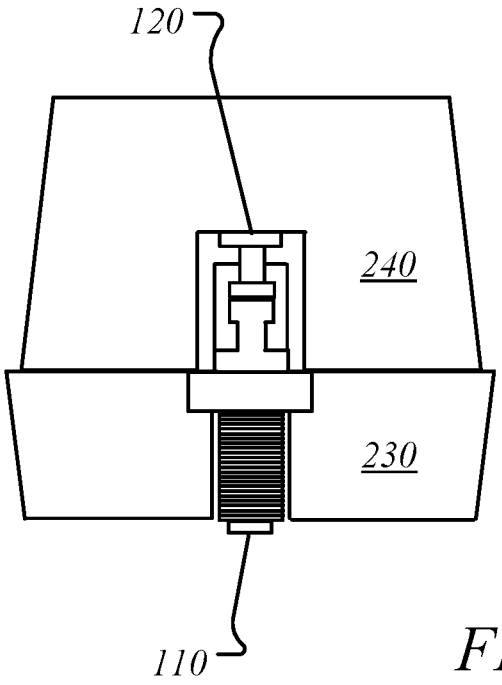
FIG. 3 is a schematic of a left mold joined to a right mold by an assembled self-lock and pull-stud according to one embodiment.

FIG. 3 is a schematic of the left mold 230 joined to the right mold 240 by the assembled self-lock 110 and pull stud 120. The assembled self-lock 110 and pull stud 120 keeps the two halves of the mold together when it is removed from the die cast machine for maintenance. In addition, the assembled self-lock 110 and pull stud 120 keeps any cores from sliding out of the left mold 230 and/or the right mold 240 when the joined halves of the mold are transported.

During maintenance of either the left mold 230 or the right mold 240, the self-lock 110 needs to be removed and replaced with a new self-lock 110 when the maintenance is finished. One current method to remove the self-lock 110 from either the left mold 230 or the right mold 240 includes using an adjustable wrench. However, the size of the self-lock 110 requires an adjustable wrench of approximately two feet in length. The size of the wrench usually requires two users in which one user pulls on the adjustable wrench and a second user bangs on the adjustable wrench with a hammer to assist in loosening the self-lock 110. This method is disadvantageous because it puts both users at risk of safety since the adjustable wrench can easily slip from the self-lock 110. In addition, the self-lock 110 can be damaged and therefore, cannot be used again.

A conventional socket can possibly fit over the end of the self-lock 110. However, there is nothing for the round socket to brace against in order to loosen the round threaded end of the self-lock 110 with a ratchet of the socket.

Figure 4A:
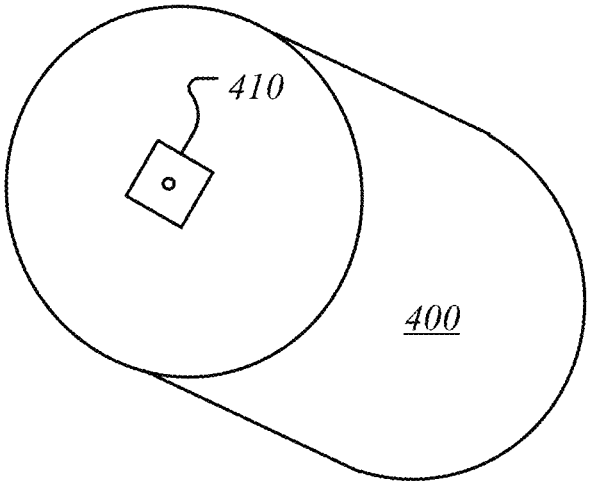
FIG. 4A is a schematic of a perspective exterior view of a socket according to one embodiment.

FIG. 4A is a schematic of a perspective exterior view of a socket 400 according to embodiments described herein. Socket 400 includes a hollow cylindrical body having a first closed end. A ratchet notch 410 in the closed end of socket 400 is configured to be mated with a ratchet of the same size, such as ½" or ¾" for loosening and tightening an item with socket 400.

Figure 4B:
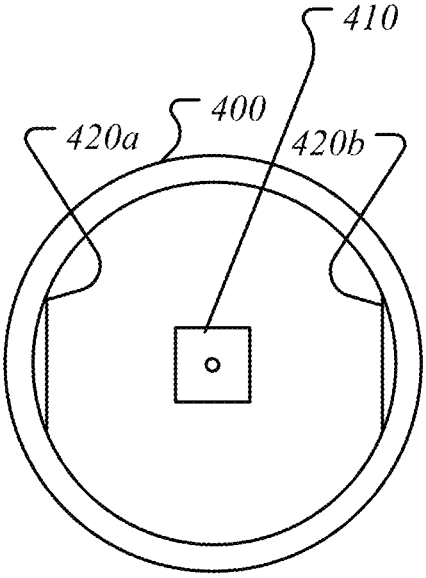
FIG. 4B is a schematic of a top interior view of a socket according to one embodiment.

FIG. 4B is a schematic of a top interior view of socket 400 through a second open end. The interior wall of socket 400 includes a left flat surface 420*a* and a symmetrically opposed right flat surface 420*b* within the rounded curvature of socket 400. Lower edges of the left flat surface 420*a* and the right flat surface 420*b* are adjacent to the first closed end of socket 400. The left flat surface 420*a* and the right flat surface 420*b* are configured to mate with respective flat surfaces of an item to be removed or inserted by socket 400, such as the self-lock 110 or the pull stud 120.

Figure 4C:
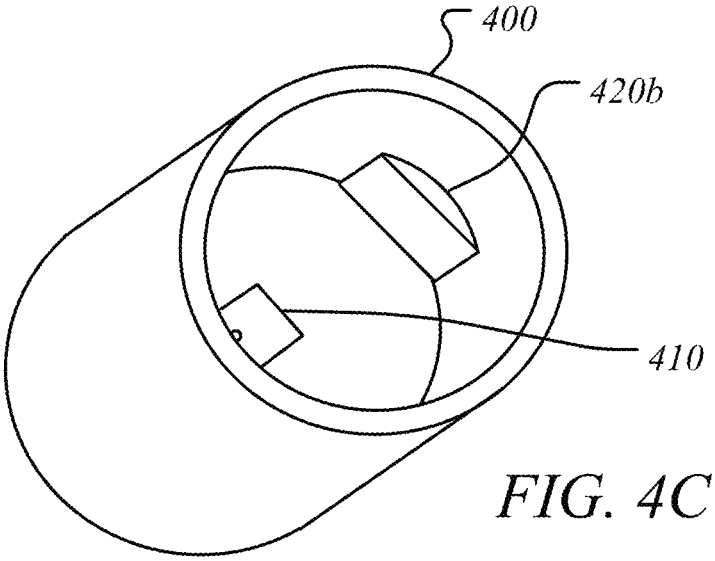
FIG. 4C is a schematic of a perspective interior view of a socket according to one embodiment.

FIG. 4C is a schematic of a perspective interior view of socket 400. As illustrated in FIG. 4C, the height of the right flat surface 420*b* extends approximately ⅓ of the total length of socket 400 as measured from the first closed end of socket 400. The left flat surface 420*a* (out of view in FIG. 4C) equally extends approximately ⅓ of the total length of socket 400 as measured from the first closed end of socket 400. However, other heights for the right flat surface 420*b* and the left flat surface 420*a* are contemplated by embodiments described herein and will depend upon the intended use of socket 400. The top edges of the left flat surface 420*a* and the right flat surface 420*b* form a square shoulder with the respective areas of the left flat surface 420*a* and the right flat surface 420*b*. In one embodiment, socket 400 is configured to safely remove the self-lock 110 from the left mold 230 with little or no damage occurring. Socket 400 fits over the entire self-lock 110 to safely remove it without the risk of slipping off the self-lock 110 while loosening or tightening it.

Figure 5A:
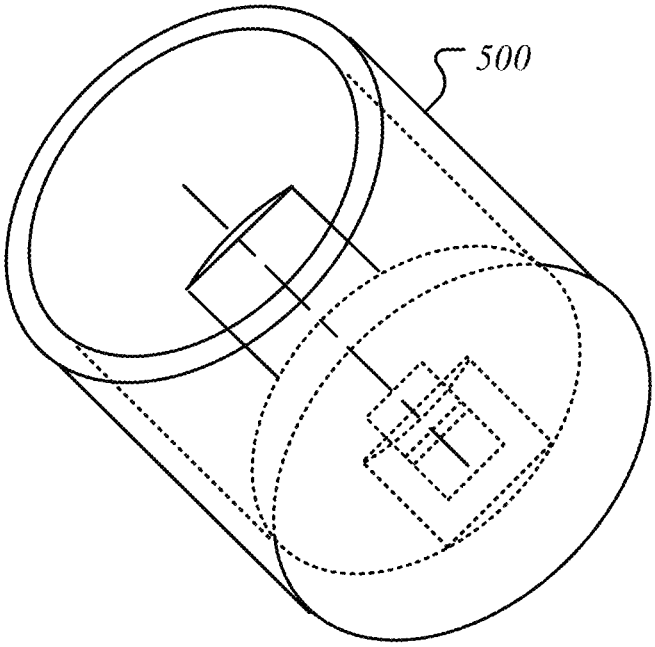
FIG. 5A is a schematic of a perspective view of an exemplary socket according to one embodiment.
Figure 5B:
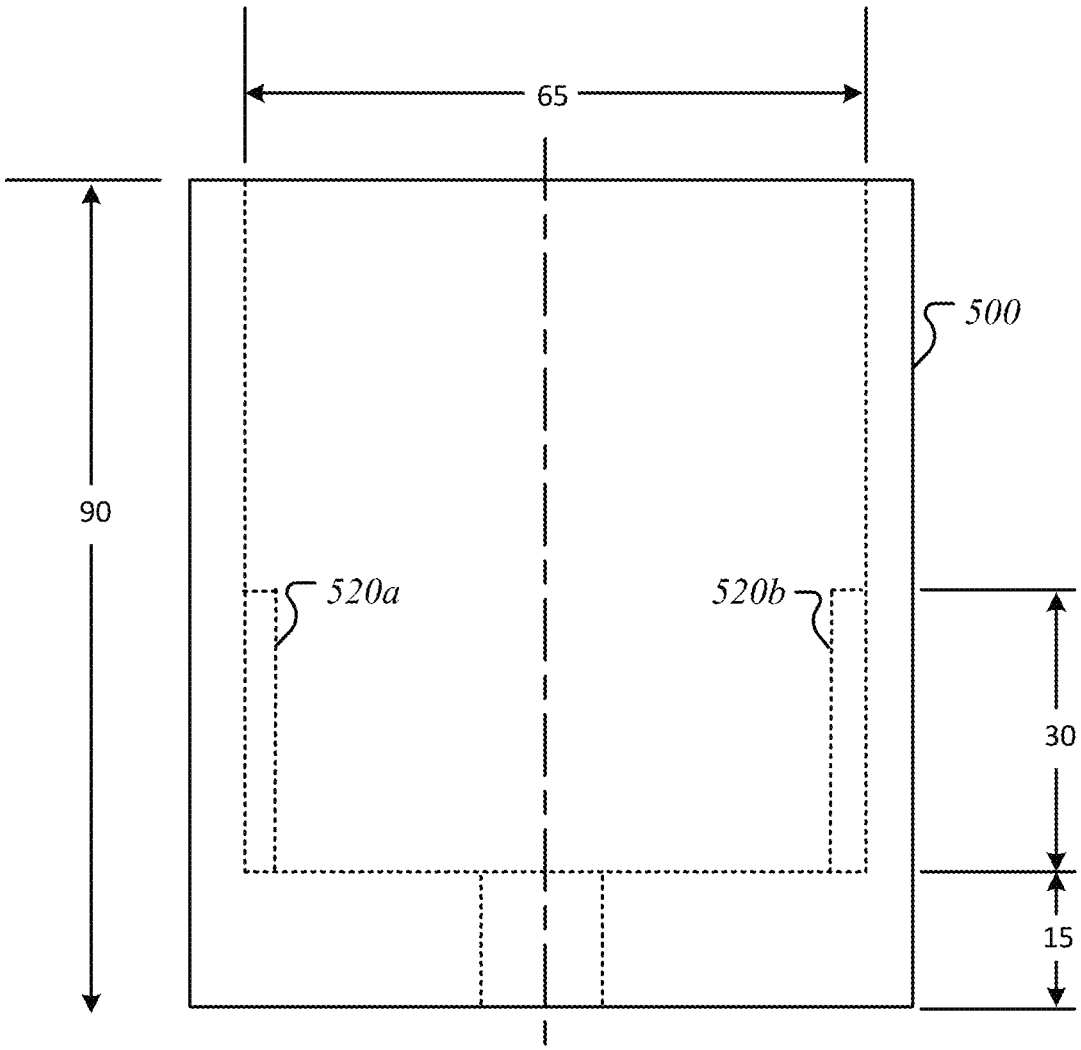
FIG. 5B is a schematic of a side view of an exemplary socket according to one embodiment.
Figure 5C:
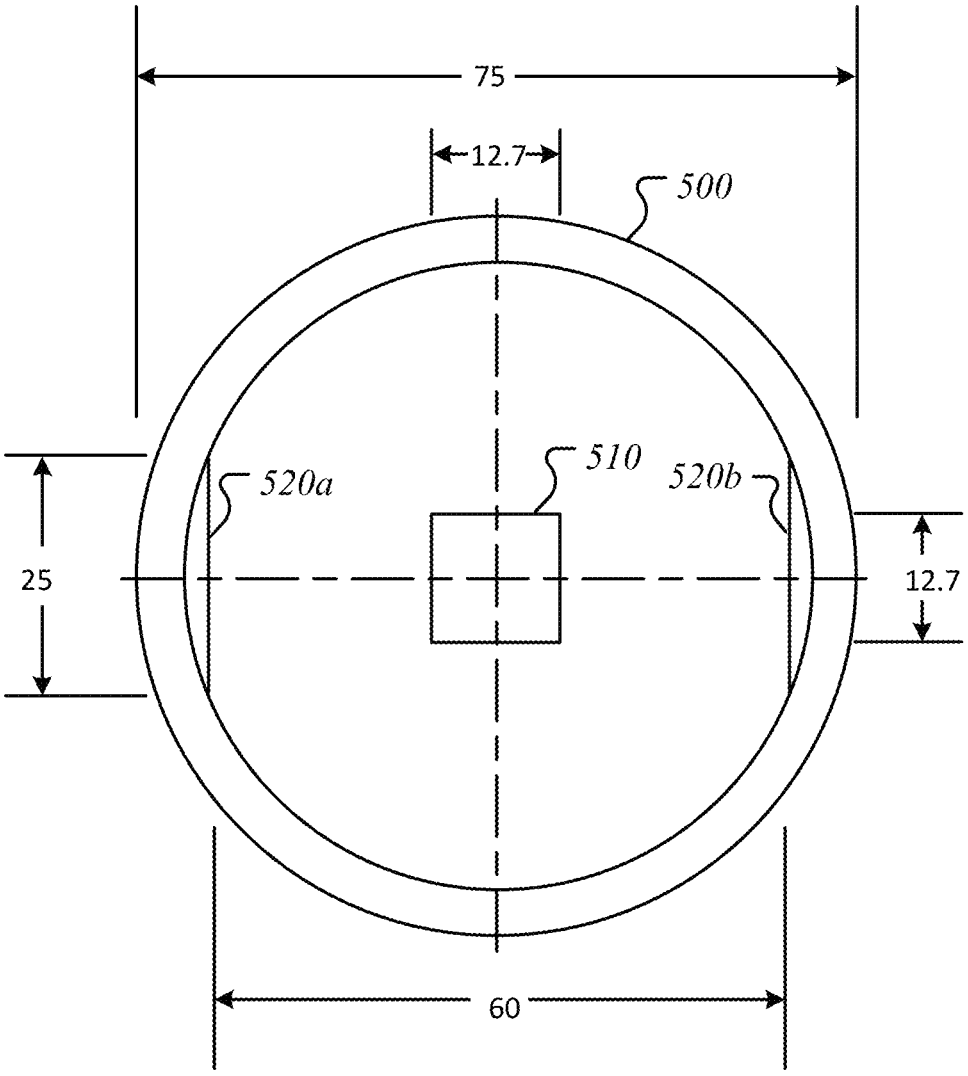
FIG. 5C is a schematic of a top view of an exemplary socket according to one embodiment.

FIG. 5A is a schematic of a perspective view of an exemplary socket 500 as used in embodiments described herein. FIG. 5B is a schematic of a side view of socket 500 illustrating a height of the right flat surface 520*b* and the left flat surface 520*a*. FIG. 5C is a schematic of a top view of socket 500 illustrating a width of the right flat surface 520*b* and the left flat surface 520*a* within the round interior surface of the socket 500 and with respect to the ratchet notch 510.

In one embodiment, socket 500 is configured to safely remove the self-lock 110 from the left mold 230 with little or no damage occurring. An exemplary size for socket 500 illustrated in FIGS. 5B and 5C is a length of 90 mm, an outside diameter of 75 mm, an inside diameter between the right flat surface 520*b* and the left flat surface 520*a* of 60 mm, a length of the right flat surface 520*b* and the left flat surface 520*a* of 30 mm, and a depth of the right flat surface 520*b* and the left flat surface 520*a* of 25 mm.

FIGS. 5A-5C are given for illustrative purposes only. Other sizes and dimensions for socket 500 are contemplated by embodiments described herein and will depend upon the intended use of socket 500. For example, a length of the right flat surface 520*b* and the left flat surface 520*a* from the closed end of socket 500 is approximately 30-40% of a total length of socket 500 from the closed end of socket 500. In another example, a depth of the right flat surface 520*b* and the left flat surface 520*a* is approximately 40-50% of a diameter between the right flat surface 520*b* and the left flat surface 520*a*. The total length of socket 500 enables it to completely fit over the item to be removed to achieve a maximum torque and safety.

Figure 6:
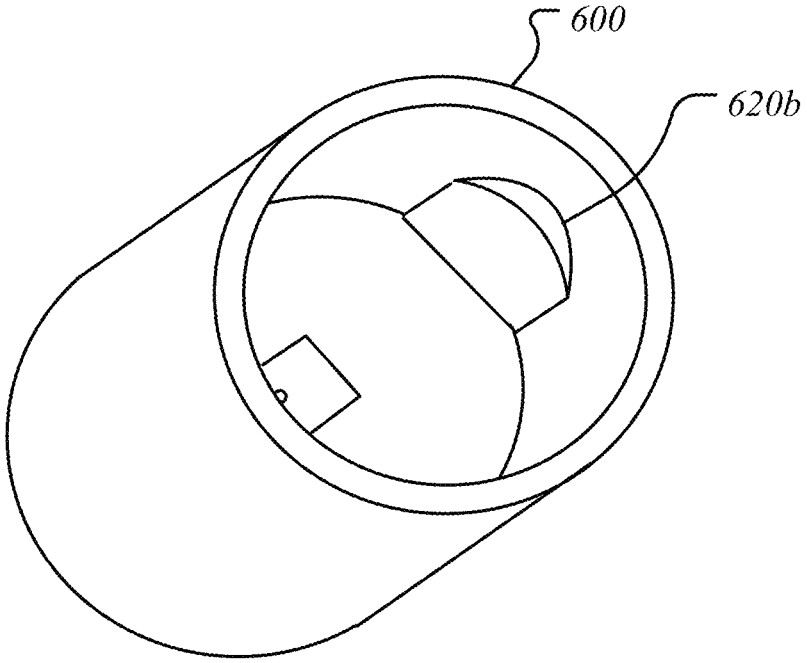
FIG. 6 is a schematic of a perspective interior view of an exemplary socket according to one embodiment.

FIG. 6 is a schematic of a perspective interior view of an exemplary socket 600. A right flat surface 620*b* of FIG. 6 includes a rounded shoulder at an upper edge of the right flat surface 620*b*, as opposed to a square shoulder illustrated in some of FIGS. 4A-4C and FIGS. 5A-5C. Socket 600 also has a symmetrically opposed left flat surface with a rounded shoulder at an upper edge of the left flat surface, which is out of view in FIG. 6. In one embodiment, socket 600 is configured to safely remove the pull stud 120 from the right mold 240 with little or no damage occurring. An exemplary length of the right flat surface 620*b* (and left flat surface out of view in FIG. 6) of socket 600 is approximately 10-15 mm. However, other sizes and dimensions of socket 600 are contemplated by embodiments described herein and will depend upon the intended use of socket 600.

Figure 7:
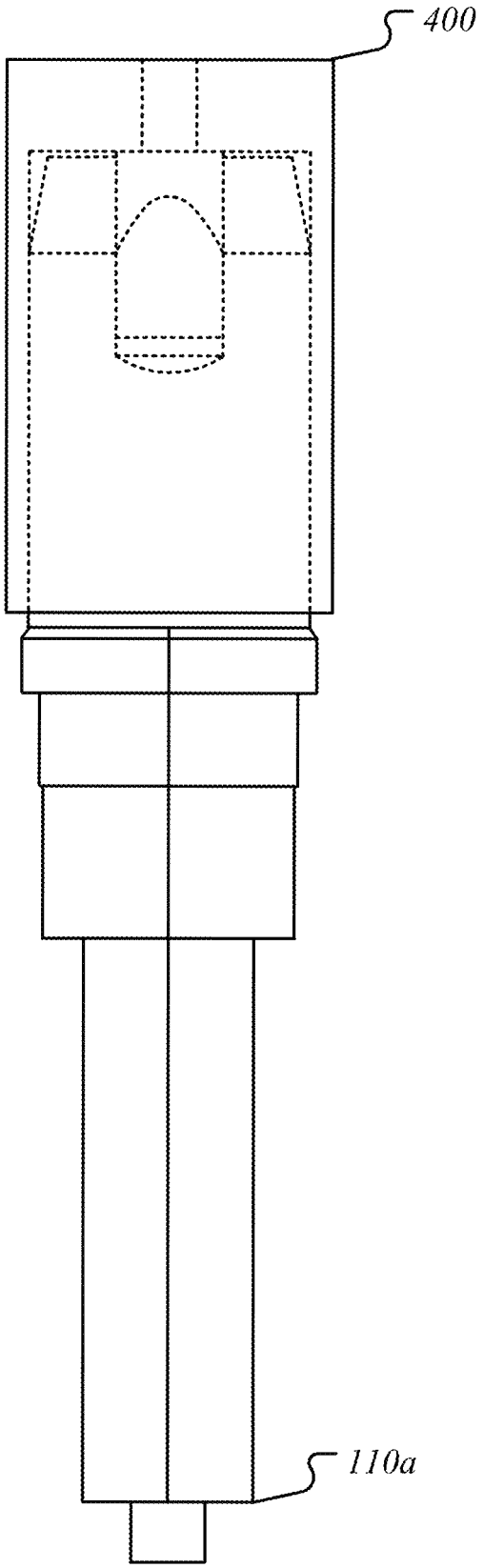
FIG. 7 is a schematic of a self-lock inserted into a socket according to one embodiment.
Figure 8:
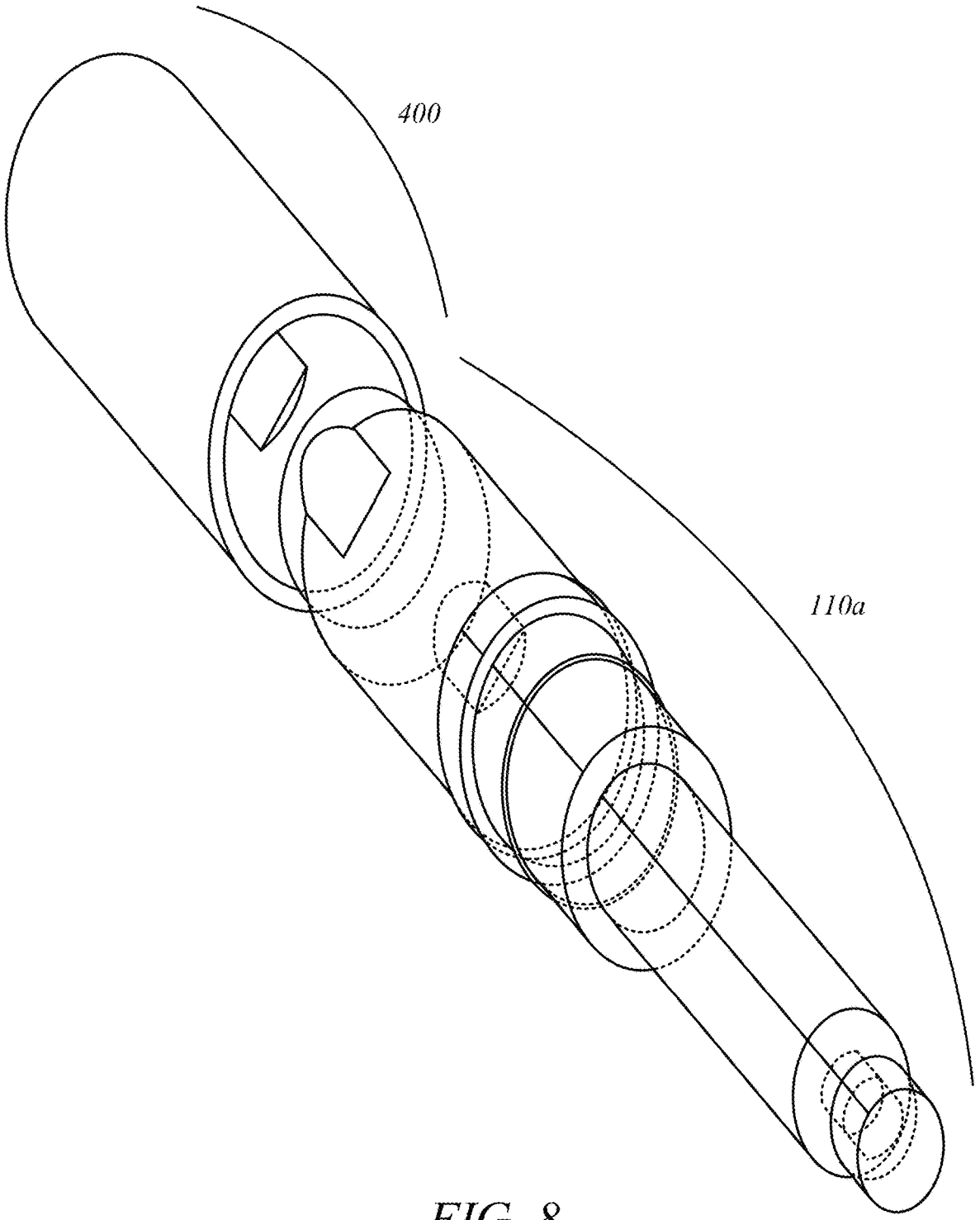
FIG. 8 is a perspective see-through view of a self-lock inserted into a socket according to one embodiment.

According to an alternative embodiment, the self-lock 110 can be elongated. An elongated self-lock 110*a* can be configured to function similarly to self-lock 110. For example, elongated self-lock 110*a* can be used in cases where the left mold 230 includes deeper threading for further securing elongated self-lock 110*a* in the mold. FIG. 7 is a schematic illustrating elongated self-lock 110*a* inserted into socket 400. FIG. 8 is a perspective see-through view of elongated self-lock 110*a* inserted into socket 400.

Materials for any of sockets 400, 500, and 600 include stainless steel. In another embodiment, chrome molybdenum is used for sockets 400, 500, and 600. However, any materials that include or can be treated to include hardness, minimum brittleness, and can be machined to high tolerances are contemplated by embodiments described herein. In one embodiment, sockets 400, 500, and 600 are machined as a single contiguous tool.

Embodiments described herein provide customized sockets that are configured to remove items that cannot be removed by a conventional socket. The dual adjacent flat surfaces within the interior of the socket provide pressure application flanges for a bi-directional force to be applied on either side of an item during installation or removal. The internal diameter and mounting flange surfaces can be precisely machined to provide a guide for removing an item quickly and safely.

Embodiments described herein include the following aspects.

(1) A socket includes a hollow cylindrical body having a first closed end and a second open end, wherein the first closed end includes a receptacle configured to receive a ratchet; a first flat surface located on an inner surface of the hollow cylindrical body; and a second flat surface symmetrically opposed to the first flat surface and located on the inner surface of the hollow cylindrical body.

(2) The socket of (1), wherein a lower edge of the first flat surface and a lower edge of the second flat surface are located adjacent to the first closed end of the socket.

(3) The socket of either one of (1) or (2), wherein a length of the first flat surface and the second flat surface from the first closed end is approximately 30-40% of a total length of the socket from the first closed end.

(4) The socket of any one of (1) through (3), wherein a depth of the first flat surface and the second flat surface is approximately 40-50% of a diameter between the first flat surface and the second flat surface.

(5) The socket of any one of (1) through (4), wherein an upper edge of the first flat surface and an upper edge of the second flat surface form a square shoulder with an area of the respective first flat surface and the second flat surface.

(6) The socket of any one of (1) through (5), wherein an upper edge of the first flat surface and an upper edge of the second flat surface form a rounded shoulder with an area of the respective first flat surface and the second flat surface.

(7) The socket of any one of (1) through (6), wherein a material of the socket comprises stainless steel.

(8) The socket of any one of (1) through (7), wherein the socket comprises a single contiguous machined tool.

(9) A socket includes a hollow cylindrical body having a first closed end and a second open end, wherein the first closed end includes a receptacle configured to receive a ratchet; a first flat surface located on an inner surface of the hollow cylindrical body; and a second flat surface symmetrically opposed to the first flat surface and located on the inner surface of the hollow cylindrical body, wherein an upper edge of the first flat surface and an upper edge of the second flat surface form a square shoulder with an area of the respective first flat surface and the second flat surface.

(10) The socket of (9), wherein a lower edge of the first flat surface and a lower edge of the second flat surface are located adjacent to the first closed end of the socket.

(11) The socket of either one of (9) or (10), wherein a length of the first flat surface and the second flat surface from the first closed end is approximately 30-40% of a total length of the socket from the first closed end.

(12) The socket of any one of (9) through (11), wherein a depth of the first flat surface and the second flat surface is approximately 40-50% of a diameter between the first flat surface and the second flat surface.

(13) The socket of any one of (9) through (12), wherein a material of the socket comprises stainless steel.

(14) The socket of any one of (9) through (13), wherein the socket comprises a single contiguous machined tool.

(15) A socket includes a hollow cylindrical body having a first closed end and a second open end, wherein the first closed end includes a receptacle configured to receive a ratchet; a first flat surface located on an inner surface of the hollow cylindrical body; and a second flat surface symmetrically opposed to the first flat surface and located on the inner surface of the hollow cylindrical body, wherein an upper edge of the first flat surface and an upper edge of the second flat surface form a rounded shoulder with an area of the respective first flat surface and the second flat surface.

(16) The socket of (15), wherein a lower edge of the first flat surface and a lower edge of the second flat surface are located adjacent to the first closed end of the socket.

(17) The socket of either one of (15) or (16), wherein a length of the first flat surface and the second flat surface from the first closed end is approximately 30-40% of a total length of the socket from the first closed end.

(18) The socket of any one of (15) through (17), wherein a depth of the first flat surface and the second flat surface is approximately 40-50% of a diameter between the first flat surface and the second flat surface.

(19) The socket of any one of (15) through (18), wherein a material of the socket comprises stainless steel.

(20) The socket of any one of (15) through (19), wherein the socket comprises a single contiguous machined tool.

A number of implementations have been described. Nevertheless, it will be understood that various modifications may be made without departing from the spirit and scope of this disclosure. For example, preferable results may be achieved if the steps of the disclosed techniques were performed in a different sequence, if components in the disclosed systems were combined in a different manner, or if the components were replaced or supplemented by other components.

The foregoing discussion describes merely exemplary embodiments of the present disclosure. As will be understood by those skilled in the art, the present disclosure may be embodied in other specific forms without departing from the spirit or essential characteristics thereof. Accordingly, the disclosure is intended to be illustrative, but not limiting of the scope of the disclosure, as well as the claims. The disclosure, including any readily discernible variants of the teachings herein, defines in part, the scope of the foregoing claim terminology such that no inventive subject matter is dedicated to the public.

The invention claimed is:

1. A socket, comprising:

a hollow cylindrical body having a first closed end and a second open end, wherein the cylindrical shape of the body at the second open end is defined by a closed circular outer circumference and a closed circular inner circumference, and the first closed end includes a receptacle configured to receive a ratchet;

a first continuous planar surface located on an inner surface of the hollow cylindrical body, a center of the first continuous planar surface being aligned with a center of the hollow cylindrical body; and a second continuous planar surface symmetrically opposed to the first continuous planar surface and located on the inner surface of the hollow cylindrical body, a center of the second continuous planar surface aligned with a center of the hollow cylindrical body, wherein a depth of the first continuous planar surface and the second continuous planar surface is approximately 40-50% of a diameter between the first continuous planar surface and the second continuous planar surface, and wherein a length of the first flat continuous planar surface and the second flat continuous planar surface from the first closed end is approximately 30-40% of a total length of the socket from the first closed end.

2. The socket of claim 1, wherein a lower edge of the first continuous planar surface and a lower edge of the second continuous planar surface are located adjacent to the first closed end of the socket.

3. The socket of claim 1, wherein a length of the first continuous planar surface and the second continuous planar surface from the first closed end is 45 mm and the depth of the first continuous planar surface and the second continuous surface is 25 mm.

4. The socket of claim 1, wherein an upper edge of the first continuous planar surface and an upper edge of the second continuous planar surface form a square shoulder with an area of the respective first continuous planar surface and the second continuous planar surface.

5. The socket of claim 1, wherein an upper edge of the first continuous planar surface and an upper edge of the second continuous planar surface form a rounded shoulder with an area of the respective first continuous planar surface and the second continuous planar surface.

6. The socket of claim 1, wherein a material of the socket comprises stainless steel.

7. The socket of claim 1, wherein the socket comprises a single contiguous machined tool.

8. A socket, comprising:

a hollow cylindrical body having a first closed end and a second open end, wherein the cylindrical shape of the body at the second open end is defined by a closed circular outer circumference and a closed circular inner circumference, and the first closed end includes a receptacle configured to receive a ratchet;

a first continuous planar surface located on an inner surface of the hollow cylindrical body; and a second continuous planar surface symmetrically opposed to the first continuous planar surface and located on the inner surface of the hollow cylindrical body, wherein an upper edge of the first continuous planar surface and an upper edge of the second continuous planar surface form a square shoulder with an area of the respective first continuous planar surface and the second continuous planar surface, a depth of the first continuous planar surface and the second continuous planar surface is approximately 40-50% of a diameter between the first continuous planar surface and the second continuous planar surface, and wherein a length of the first flat continuous planar surface and the second flat continuous planar surface from the first closed end is approximately 30-40% of a total length of the socket from the first closed end.

9. The socket of claim 8, wherein a lower edge of the first continuous planar surface and a lower edge of the second continuous planar surface are located adjacent to the first closed end of the socket.

10. The socket of claim 8, wherein a length of the first continuous planar surface and the second continuous planar surface from the first closed end is 45 mm and the depth of the first continuous planar surface and the second continuous surface is 25 mm.

11. The socket of claim 8, wherein a material of the socket comprises stainless steel.

12. The socket of claim 8, wherein the socket comprises a single contiguous machined tool.

13. A socket, comprising:

a hollow cylindrical body having a first closed end and a second open end, wherein the cylindrical shape of the body at the second open end is defined by a closed circular outer circumference and a closed circular inner circumference, and the first closed end includes a receptacle configured to receive a ratchet;

a first continuous planar surface located on an inner surface of the hollow cylindrical body; and a second continuous planar surface symmetrically opposed to the first continuous planar surface and located on the inner surface of the hollow cylindrical body, wherein an upper edge of the first continuous planar surface and an upper edge of the second continuous planar surface form a rounded shoulder with an area of the respective first flat continuous planar surface and the second continuous planar surface, a depth of the first continuous planar surface and the second continuous planar surface is approximately 40-50% of a diameter between the first continuous planar surface and the second continuous planar surface, and wherein a length of the first continuous planar surface and the second continuous planar surface from the first closed end is approximately 30-40% of a total length of the socket from the first closed end.

14. The socket of claim 13, wherein a lower edge of the first continuous planar surface and a lower edge of the second continuous planar surface are located adjacent to the first closed end of the socket.

15. The socket of claim 13, wherein a length of the first continuous planar surface and the second continuous planar surface from the first closed end is 45 mm and the depth of the first continuous planar surface and the second continuous surface is 25 mm.

16. The socket of claim 13, wherein a material of the socket comprises stainless steel.

17. The socket of claim 13, wherein the socket comprises a single contiguous machined tool.

* * * * *